US008146615B1

(12) United States Patent
Rodriguez

(10) Patent No.: US 8,146,615 B1
(45) Date of Patent: Apr. 3, 2012

(54) CRUTCH DEVICE WITH LEG SUPPORT

(76) Inventor: Yeniel Rodriguez, Miami, FL (US)

( * ) Notice: Subject to any disclaimer, the term of this patent is extended or adjusted under 35 U.S.C. 154(b) by 0 days.

(21) Appl. No.: 12/717,041

(22) Filed: Mar. 3, 2010

(51) Int. Cl.
*A61H 3/02* (2006.01)
*A45B 3/00* (2006.01)
*A45B 5/00* (2006.01)

(52) U.S. Cl. ..... 135/68; 135/66; 135/74; 135/75

(58) Field of Classification Search ..... 135/66, 135/68, 69, 74, 75, 84
See application file for complete search history.

(56) References Cited

U.S. PATENT DOCUMENTS

| | | | | |
|---|---|---|---|---|
| 1,006,791 | A | 10/1911 | Remick | |
| 1,463,675 | A | 7/1923 | Coleman | |
| 2,960,095 | A * | 11/1960 | Smith, Jr. | 135/68 |
| 4,910,927 | A * | 3/1990 | Beatty | 135/66 |
| D361,655 | S | 8/1995 | Lunceford | |
| 5,735,303 | A | 4/1998 | Cole | |
| 6,311,708 | B1 | 11/2001 | Howle | |
| 6,386,217 | B1 * | 5/2002 | Cooper et al. | 135/74 |
| 6,491,050 | B2 | 12/2002 | Whiddon | |
| 6,932,096 | B2 | 8/2005 | Marek | |
| 7,614,414 | B2 * | 11/2009 | Jamshidi | 135/66 |
| 2007/0074748 | A1 | 4/2007 | Jamshidi | |

* cited by examiner

*Primary Examiner* — David Dunn
*Assistant Examiner* — Danielle Jackson

(57) ABSTRACT

A crutch device adapted for use as a leg support featuring a crutch frame with an underarm pad, a handle, and a bottom shaft; a leg support bar pivotally attached to the shaft, the leg support bar can move between a vertical position wherein the leg support bar is positioned above the shaft inside the crutch frame and a horizontal position wherein the leg support bar is pivoted out of the crutch frame and generally perpendicularly to the shaft; and a two-legged support component pivotally attached to the leg support bar, the two-legged support component can move between a storage position and a usage position wherein the two-legged support component is pivoted such that it is generally perpendicular to the leg support bar, wherein the support component is adapted to be received in the crutch frame when the support component is in the storage position.

7 Claims, 5 Drawing Sheets

CRUTCH DEVICE WITH LEG SUPPORT

FIELD OF THE INVENTION

The present invention is directed to crutches, more particularly to a crutch with a leg support that can be unfolded from the crutch.

BACKGROUND OF THE INVENTION

An individual using crutches may often find him/herself in a location lacking a supportive object such as a table, chair, or cushion for supporting his/her injured leg. The present invention features a crutch device that comprises a leg support for supporting the user's leg when he or she wishes to rest.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
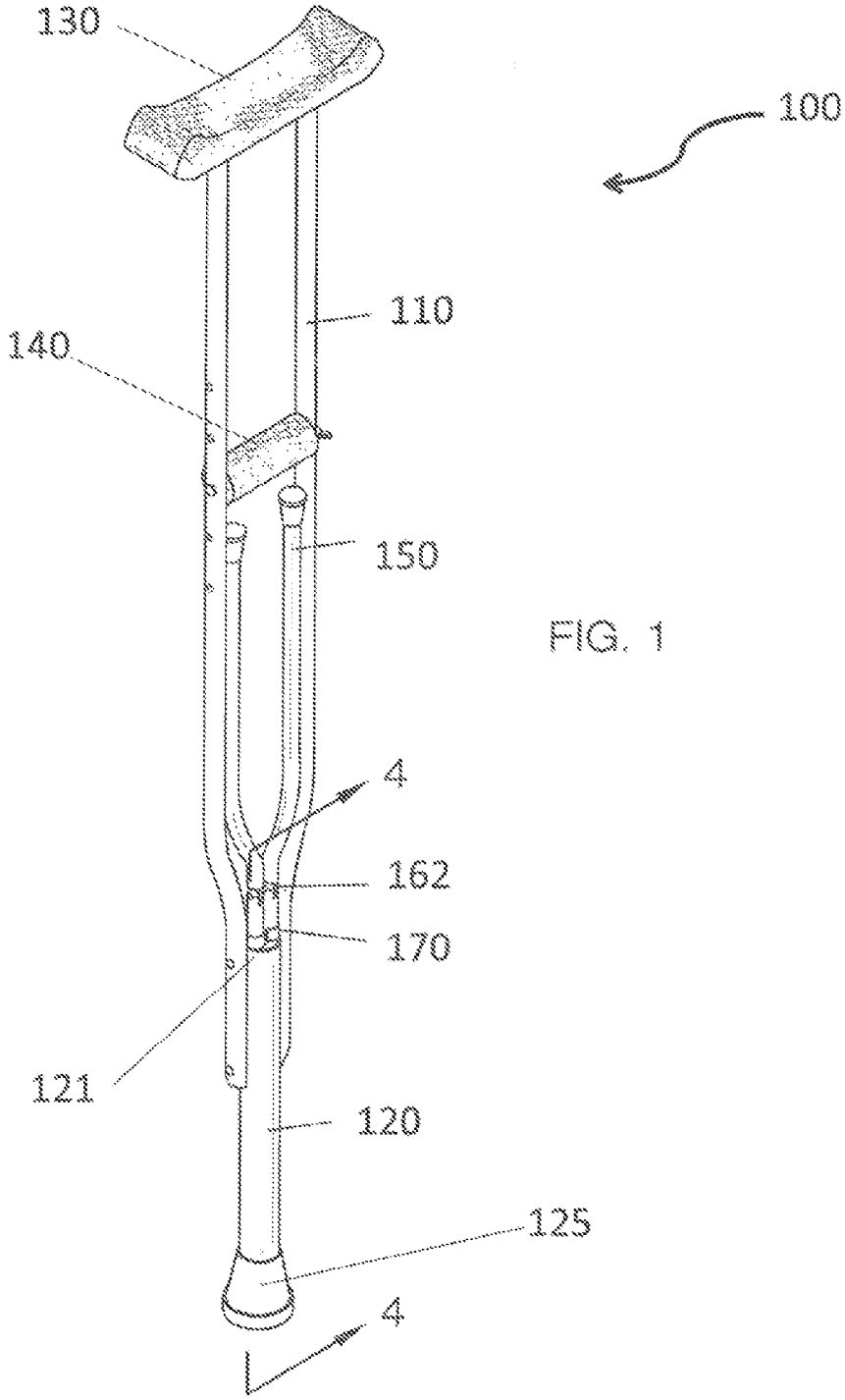
FIG. 1 is a first perspective view of the crutch device of the present invention.
Figure 2:
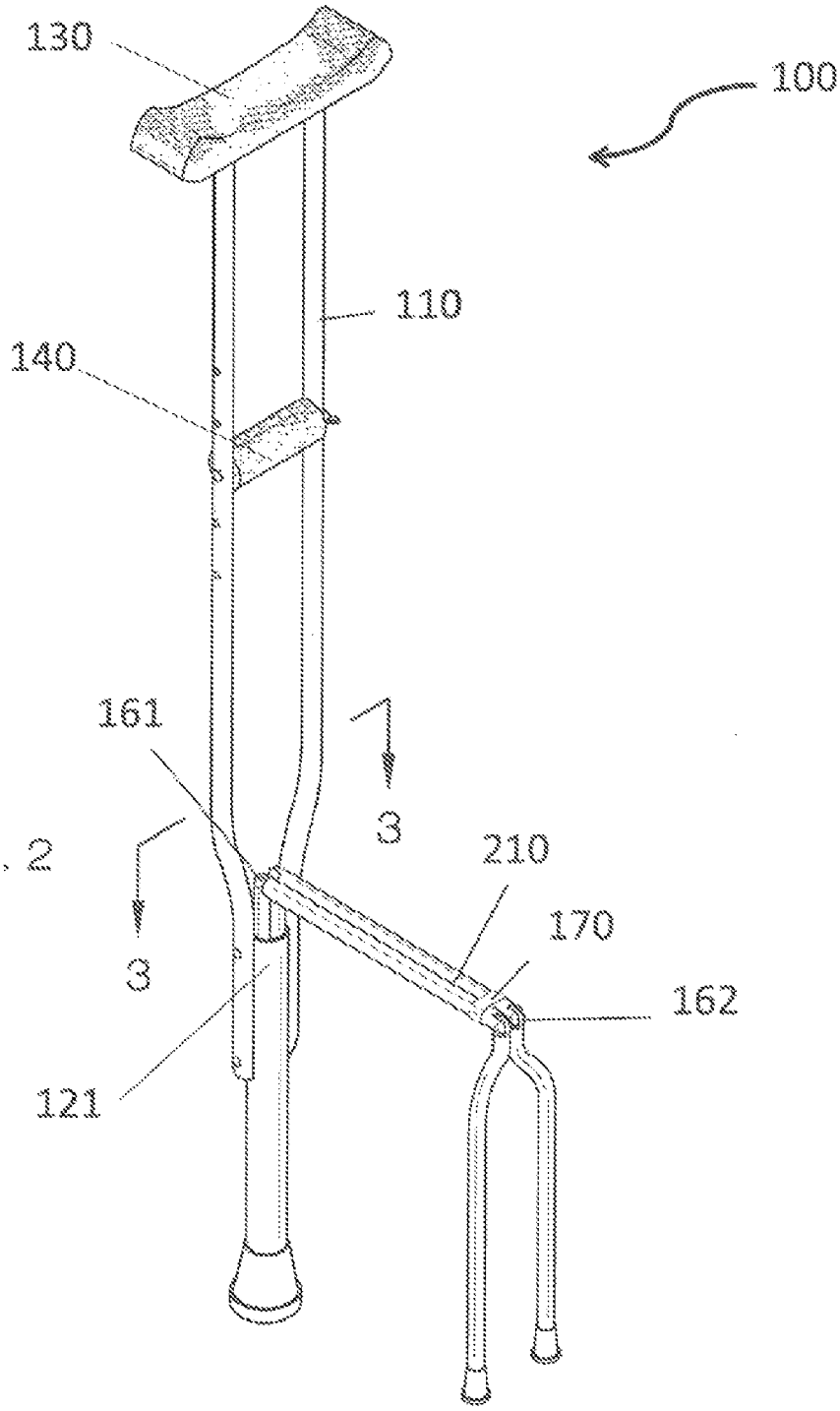
FIG. 2 is a second perspective view of the crutch device of the present invention.
Figure 3:
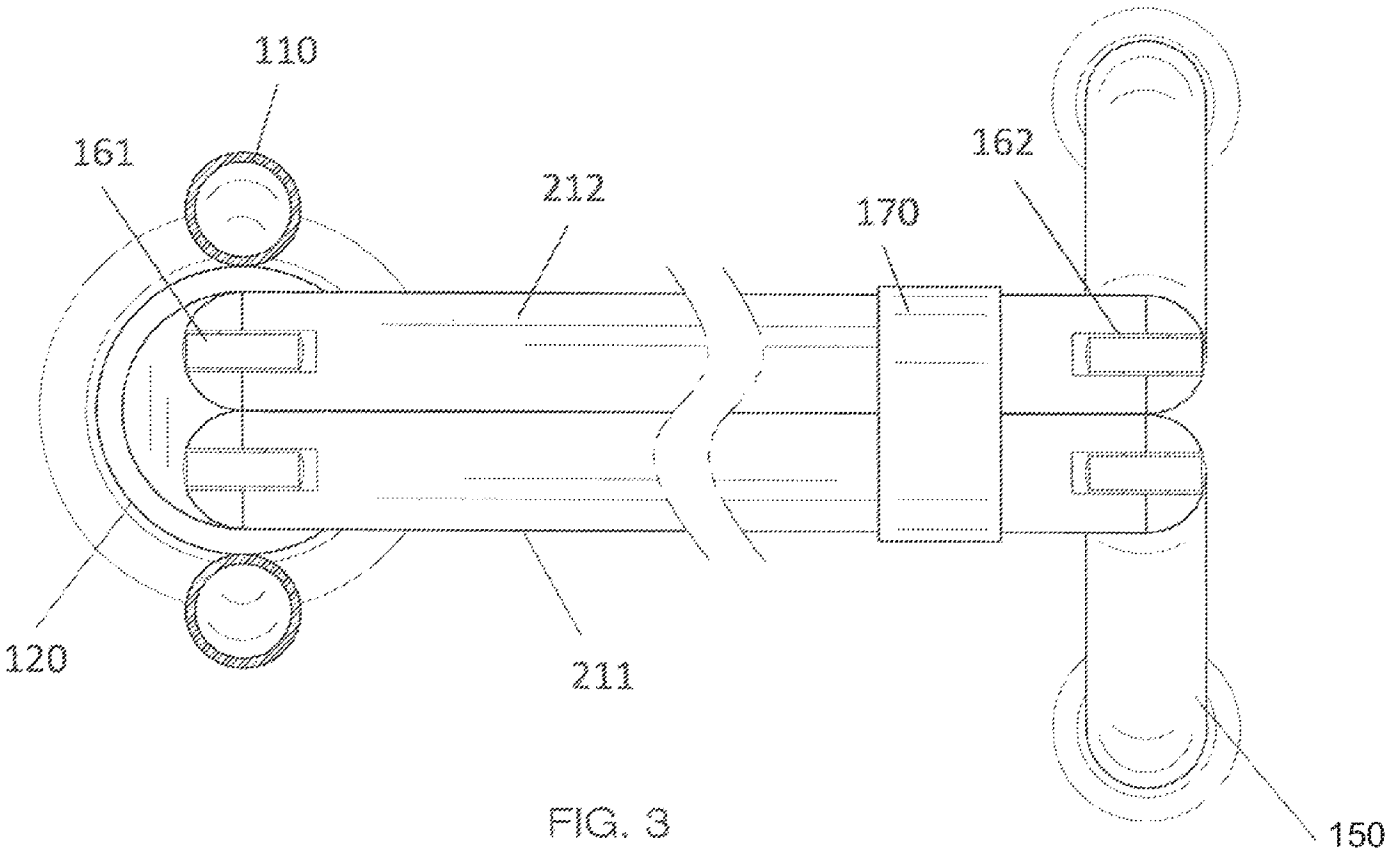
FIG. 3 is a top cross sectional view of the crutch device of FIG. 2.

Referring now to FIG. 1-5, the present invention features a crutch device 100 adapted for use as a leg support when a user is sitting. The crutch device 100 comprises a crutch frame 110, which is similar to standard crutch frames well known to one of ordinary skill in the art. For example, the crutch frame 110 has a top end with a foam pad 130 disposed thereon. The top end is for placing under a user's underarms. A shaft 120 is disposed at the bottom end of the crutch frame 110. The shaft 120 has a rubber tip 125 disposed on the second end. The rubber tip 125 contacts the ground surface when a user uses the crutch device 100. A handle 140 is disposed in the middle of the crutch frame 110.

Pivotally attached to the first end 121 of the shaft 120 is the first end of a leg support bar 210. The leg support bar 210 may be pivotally attached to the shaft 120 via a first hinge. The leg support bar 210 can move between a vertical position (storage position) wherein the leg support bar 210 is positioned above the shaft 120 (in a vertical orientation) and in the crutch frame 110 and a horizontal position wherein the leg support bar 210 is pivoted out of the crutch frame 110 and generally perpendicularly to the shaft 120 (see FIG. 2). In some embodiments, the leg support bar 210 comprises a first bar 211 and a second bar 212. The double-bar design may provide additional support and/or additional comfort for the user.

Figure 4:
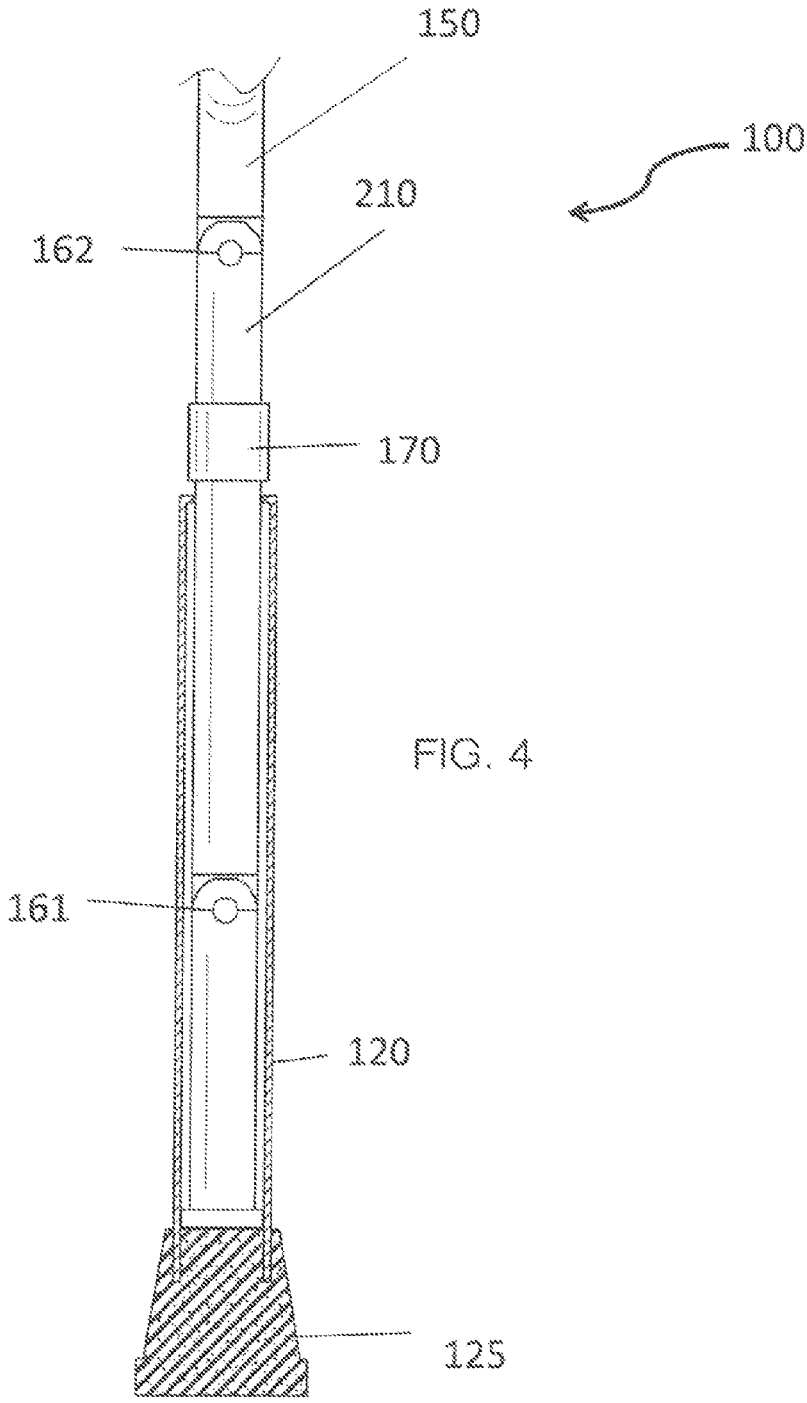
FIG. 4 is a side cross sectional view of the crutch device of FIG. 1.
Figure 5:
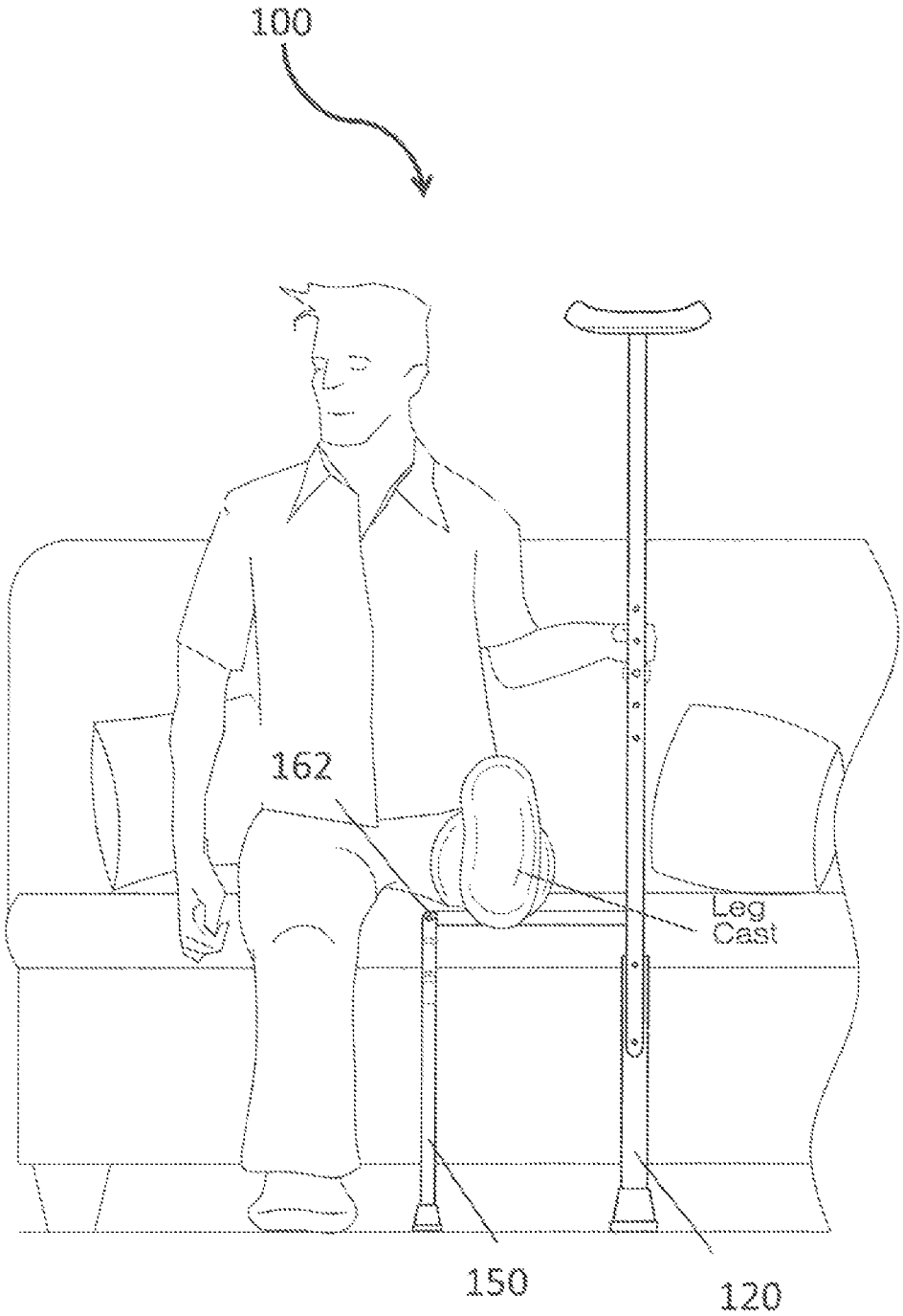
FIG. 5 is a side view of the crutch device of the present invention wherein a user is using the crutch device to rest his leg.

As shown in FIG. 1 and FIG. 4, the leg support bar 210 can be telescopically received in the shaft 120, for example for storage purposes. The leg support bar 210 can slide between an in position (in the shaft 120) and an out position (outside of the shaft 120). The leg support bar 210 may be secured in the out position via a securing means. In some embodiments, the securing means is a clamp 170. In some embodiments, the securing means is used to secure the leg support bar 210 in the in position.

Pivotally attached to the second end of the leg support bar 210 is a two-legged support component 150. The two-legged support component may be pivotally attached to the leg support bar 210 via a second hinge 162. The two-legged support component 150 can move between a storage position and a usage position. In the usage position, the two-legged support component 150 is pivoted such that it is generally perpendicular to the leg support bar 210. In the storage position, the support component 150 is in line with the leg support bar 210. The support component 150 can be fit into the crutch frame 110. When the support component 150 is pivoted perpendicularly to the leg support bar 210, it can be rested on the ground surface. This positions the leg support bar 210 horizontal to the ground surface and creates a tripod-like support stance. The tripod-like support stance (e.g., three contact points on the ground surface) provides for a stable means of supporting the user's leg.

To use the crutch device 100 of the present invention, a user can pivot the two-legged support component 150 downwardly from the storage position in the crutch frame 110. Next, the user can slide the leg support bar 210 out of the shaft 120. When the first hinge 161 is accessible, the leg support bar 210 can be pivoted downwardly to the horizontal position. The user may wish to tighten the clamp to secure the leg support bar 210. Next, the user can position the two-legged support component 150 such that it is generally perpendicular to the leg support bar 210 and parallel to the shaft 120.

The crutch device 100 may be constructed from a variety of materials. For example, in some embodiments, the crutch device 100 is constructed from a material comprising a metal (e.g., aluminum, steel), wood, plastic, foam, rubber, the like, or a combination thereof.

In some embodiments, the crutch device 100 is constructed such that the leg support bar 210 when in the horizontal position is between about 6 to 12 inches above the ground surface. In some embodiments, the crutch device 100 is constructed such that the leg support bar 210 when in the horizontal position is between about 12 to 18 inches above the ground surface. In some embodiments, the crutch device 100 is constructed such that the leg support bar 210 when in the horizontal position is between about 18 to 24 inches above the ground surface. In some embodiments, the leg support bar 210 is more than about 24 inches above the ground surface.

As used herein, the term "about" refers to plus or minus 10% of the referenced number. For example, an embodiment wherein the leg support bar 210 is about 18 inches above the ground surface includes a leg support bar 210 that is between 16.2 and 19.8 inches above the ground surface.

The following the disclosures of the following U.S. patents are incorporated in their entirety by reference herein: U.S. Pat. No. 6,932,096; U.S. Pat. Application No. 2007/0074748; U.S. Pat. No. 5,735,303; U.S. Pat. No. 6,311,708; U.S. Pat. No. 6,491,050; U.S. Pat. No. 1,463,675; U.S. Pat. No. 1,006,791;

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A crutch device adapted for use as a leg support when a user is sitting, said crutch device comprising:

(a) a crutch frame, a pad disposed on a top end of the crutch frame for supporting a user's underarms, a shaft disposed at a bottom end of the crutch frame for contacting a ground surface, and a handle disposed in a middle area of the crutch frame;

(b) a leg support bar having a first end and a second end, the first end is pivotally attached to a first end of the shaft via a first hinge, wherein the leg support bar can move between a vertical position wherein the leg support bar is positioned above the shaft in a generally vertical orientation inside the crutch frame and a horizontal position wherein the leg support bar is pivoted out of the crutch frame and generally perpendicularly to the shaft, wherein the leg support bar is telescopically received in the shaft, the leg support bar can slide between an in position wherein the leg support bar is inside the shaft and an out position wherein the leg support bar is outside the shaft;

(c) a securing means for securing the leg support bar in the in position or the out position; and (d) a two-legged support component pivotally attached to the second end of the leg support bar via a second hinge, the two-legged support component can move between a storage position wherein the two-legged support component is generally aligned with the leg support bar and a usage position wherein the two-legged support component is pivoted such that it is generally perpendicular to the leg support bar, wherein the support component is adapted to be received in the crutch frame when the support component is in the storage position.

2. The crutch device of claim 1, wherein a rubber tip is disposed on the second end of the shaft.

3. The crutch device of claim 1, wherein the leg support bar comprises a first bar and a second bar positioned parallel to each other.

4. The crutch device of claim 1, wherein the securing means is a clamp.

5. The crutch device of claim 1, wherein the crutch device is constructed such that the leg support bar when in the horizontal position is between about 6 to 12 inches above the ground surface.

6. The crutch device of claim 1, wherein the crutch device is constructed such that the leg support bar when in the horizontal position is between about 12 to 18 inches above the ground surface.

7. The crutch device of claim 1, wherein the crutch device is constructed such that the leg support bar when in the horizontal position is between about 18 to 24 inches above the ground surface.

* * * * *